United States Patent [19]

De Bose

[11] 4,165,671

[45] Aug. 28, 1979

[54] PERCUSSION INSTRUMENT

[76] Inventor: Errol A. De Bose, Lower Apartment, 3031 Dumaine, New Orleans, La. 70119

[21] Appl. No.: 867,783

[22] Filed: Jan. 9, 1978

[51] Int. Cl.[2] ..... G10D 13/06

[52] U.S. Cl. ..... 84/402; 46/193; D21/65; D17/22

[58] Field of Search ..... 84/402, 411; 46/189, 46/191, 193; D34/15 AG; D56/1 E

[56] References Cited

U.S. PATENT DOCUMENTS

| | | | |
|---|---|---|---|
| D. 165,407 | 12/1951 | Toombs et al. | D34/15 AG |
| D. 244,635 | 6/1977 | Cohen | D56/1 E |
| 2,644,890 | 7/1953 | Hollihan | 46/193 X |
| 3,521,518 | 7/1970 | Cohen | 84/402 |
| 3,566,737 | 3/1971 | Gussak | 84/402 |

*Primary Examiner*—Lawrence R. Franklin
*Attorney, Agent, or Firm*—C. Emmett Pugh & Associates, Ltd.

[57] ABSTRACT

A percussion instrument provides a plurality of substantially horizontally disposed hollow tubes having rattle elements therein. A handle providing a gripping surface connects the tubes and the connection orients the tubes in a substantially parallel orientation towards one another. In the preferred embodiment, the handle is comprised of two substantially vertical tubular members attached to the upper hollow tube, there being two substantially horizontal arms attached to the bottom portion of the vertical tubes, with the second hollow tube being attached at substantially right angles to the lower arms.

14 Claims, 5 Drawing Figures

PERCUSSION INSTRUMENT

REFERENCE TO RELATED APPLICATION

The preferred embodiment hereof is also the subject matter of design patent application Ser. No. 837,757 filed Sept. 29, 1977.

BACKGROUND OF THE INVENTION

1. Field of the Invention

The present invention relates to musical instruments and more particularly to percussion instruments. Even more particularly, the present invention relates to a percussion instrument which provides a plurality of substantially horizontal hollow tubes having rattle elements therein, and gripping elements connecting the tubes providing a gripping area for the hands of the operator.

2. Prior Art

The following table provides a listing of some devices which provide tubes and inner rattle members as is the case with the present invention.

| PRIOR ART PATENTS | | |
|---|---|---|
| U.S. Pat. No. | INVENTOR (S) | ISSUE DATE |
| 3,190,036 | R.L. Motley | June 22, 1965 |
| 3,566,737 | W. Gussak | March 2, 1971 |
| 3,633,587 | P.J. Hunt | January 11, 1972 |

3. General Discussion of the Present Invention

The present invention in its preferred embodiment provides a percussion instrument which is comprised of a plurality of substantially linear hollow tubes. Each of the hollow tubes is provided with at least one inner rattle member. A handle is provided for connecting the plurality of tubes, the handle providing a gripping surface on the instrument. The handle is comprised of at least one substantially vertical tube at least one substantially horizontal support arm depending from the lower end of the vertical tube. Thus, when the device is completely assembled, the hollow tubes, and the handle are orthagonally connected. In this configuration, the operator can move the rattle members within the hollow tubes either side to side, up and down or forward and backward to provide different sounds as desired.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
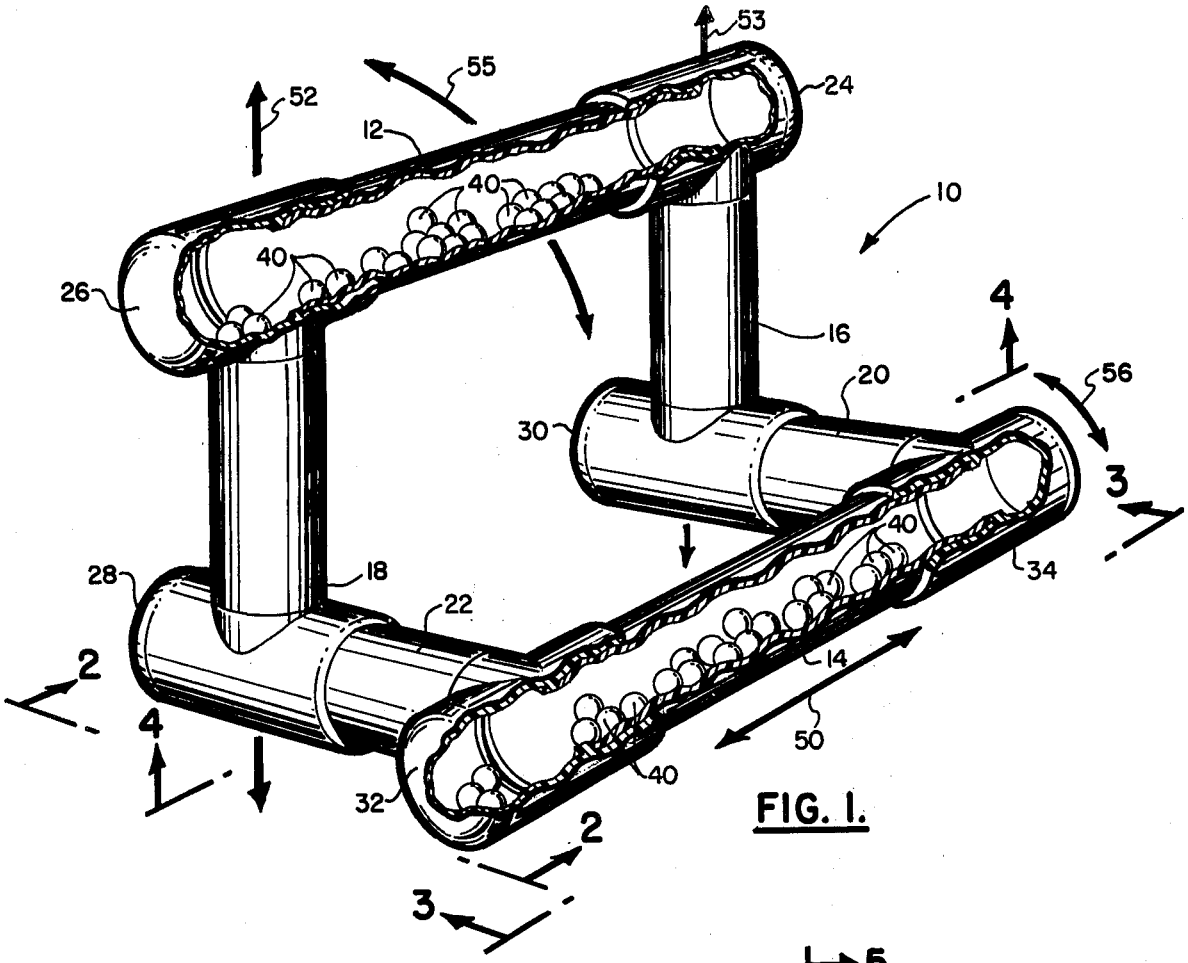
FIG. 1 is a partially cut-away perspective view of the preferred embodiment of the apparatus of the present invention.
Figure 2:
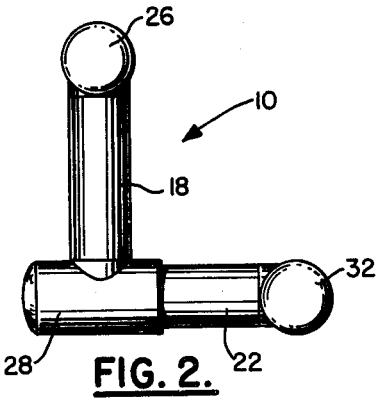
FIG. 2 is an end view taken along lines 2—2 of FIG. 1.
Figure 3:
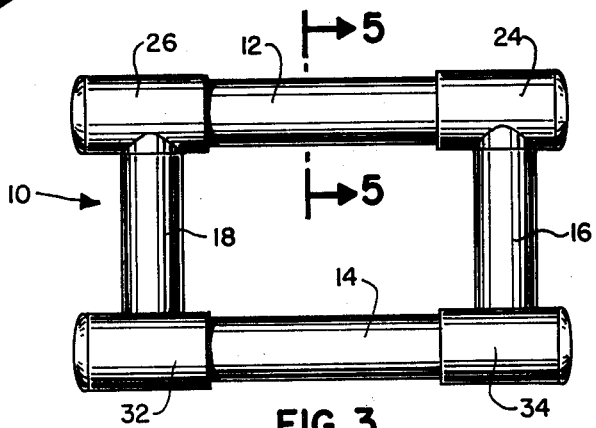
FIG. 3 is a front view taken along lines 3—3 of FIG. 1.
Figure 5:
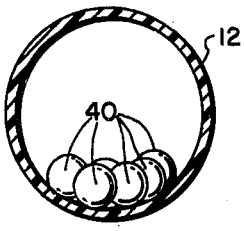
FIG. 5 is a cross-sectional view taken along section lines 5—5 of FIG. 3.
Figure 4:
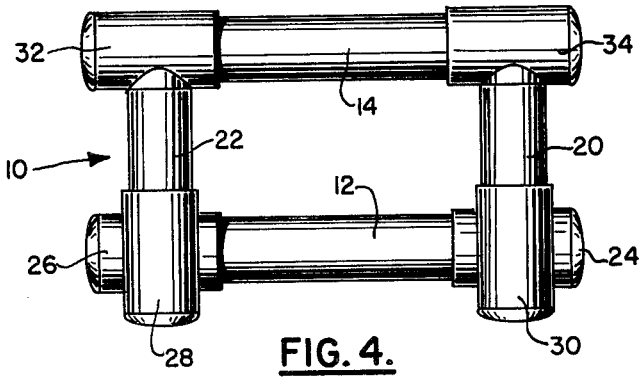
FIG. 4 is a bottom view taken along lines 4—4 of FIG. 1.

As can best be seen from the drawings, FIGS. 1-5, the percussion instrument of the present invention is designated generally by the numeral 10.

The instrument 10 is comprised of an upper tube 12 and a lower tube 14 which are of light construction having hollow interiors. As can be seen in FIG. 1, at least one rattle member 40, and preferrably a multitude of loose rattle members is provided, in each of the hollow tubes 12, 14, which rattle members 40 make a percussion sound as they move about in the tubes 12, 14, striking their interior walls with impact or sliding across them.

In the preferred embodiment, the hollow upper tube 12 and hollow lower tube 14 are preferably substantially parallel to one another. A pair of substantially vertical handle tubes 16, 18 provide an area for gripping by the hands of the operator, with the thumbs being set against and under the projecting ends of the elbow joints 28, 30. It is noted that the instrument 10 is presented in an upside down disposition in the figures.

Tubes 16 and 18 are connected and joined to upper hollow tube 12 by means of elbow joints 24,26. In a like manner, elbow joints 28, 30 are provided at the lower end portions of tubes 16, 18. These elbow joints 28, 30 provide a point of attachment for lower, outwardly depending, substantially horizontal arms 20, 22. The extensions of the tubes 28, 30 also provide auxilliary gripping areas for the thumbs (note FIG. 2). Arms 20, 22 are then provided with elbow joints 32, 34 which attach to the lower hollow tube 14.

The interiors of the rattle-containing tubes 12, 14 are preferably isolated from the connecting tubes 16/18, 20/22, so that the rattle members 40 stay within them.

It can be seen from the foregoing, that the upper and lower tubes 12, 14 and arms 16, 18 and arms 20, 22, are substantially orthagonally connected at substantially right angles.

In operation, the device can be moved from side to side as shown by arrow 50 in FIG. 1. In such an operation, rattle members 40 will slide along the longitudinal axis of their respective tubes 12, 14. Another different sound can be obtained when the operator shakes the device up and down in such a manner as to be in line with the longitudinal axis of tubes 16, 18. (Note arrows 52, 53 in FIG. 1). With this type of motion imparted to the device 10, the rattle members 40 will move only a short distance across the diameter of the upper and lower tubes 12, 14, giving a shorter, faster beat.

A similar short beat can be given to the instrument when the operator merely rotates his wrist so as to move the upper and lower tubes through arcuate paths as shown by arrows 55, 56 in FIG. 1.

In use, the instrument 19 has the sound comparable to a morracas or tambourine.

The instrument 10 can be made for example of six plastic pipe sections, and six "T" section joints and six caps, and the rattle members 40 can be made of a collection of plastic beads, a suitable number of beads being thirty in one section and fifty in the other. Suitable dimensions for the elements of the instrument 10 are outlined below:

| ELEMENT | LENGTH | DIAMETER |
|---|---|---|
| 12, 14 | 9.5" | 1.5" |

-continued

| ELEMENT | LENGTH | DIAMETER |
|---|---|---|
| 16, 18 | 4.25" | 1.5" |
| 20, 22 | 4.25" | 1.5" |
| 24, 26 | 3.5" & 1 13/16" | 1.75" |
| 28, 30 | 3.5" & 1 13/16" | 1.75" |
| 32, 34 | 3.5" & 1 13/16" | 1.75" |

The instrument 10 can be used for other purposes, such as for example, a phonograph album holder or stand.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A hand percussion instrument, comprising:

a. at least two substantially linear and parallel, extended hollow tubes spaced apart from one another;

b. loose rattle means in said tubes for making percussion sounds as they move about in said tubes; and c. handle means, extending across from one of said tubes to the other and connecting said tubes together, for gripping with the human hand between said spaced tubes and for moving the instrument about to cause said loose rattle means to produce percussion sound as they move about in said tubes.

2. The instrument of claim 1, wherein said handle means is comprised of at least one pair of substantially orthogonally connected tube members, and the said pair of tube members are connected orthogonally to said hollow tubes.

3. The instrument of claim 1 wherein the gripping portion of said handle means extends at least in part substantially outside of the plane defined by said two parallel linear tubes.

4. The instrument of claim 3 wherein said tubes are provided as an upper tube and a lower tube, and wherein said handle means is comprised of at least one generally vertical handle member intersecting said upper tube at substantially right angles, and at least one substantially horizontal arm attached at one end to the lower portion of said handle member and at the other end to said lower tube said handle member forming the gripping portion of said handle means.

5. The instrument of claim 4 wherein said handle member and said arm forms an "L".

6. The instrument of claim 5 wherein said tubes and said handle means are made up of plastic pipe joints and sections joined together in orthogonal relationships.

7. The instrument of claim 6, wherein said pipe joints are "T" sections having end caps at their distal ends.

8. The instrument of claim 7, wherein the distal end portions of two of said "T" sections form thumb means for gripping and bearing against by the thumbs of the user.

9. The instrument of claim 5 wherein there are two of said handle members, each parallel to the other, and two of said arms, each parallel to the other, the two sets of handle members and arms forming two, identical "L's".

10. The instrument of claim 9 wherein said handle members and said arms are attached to the ends of said parallel tubes.

11. The instrument of claim 9 wherein said parallel tubes are equal in length and the formed "L's" are parallel to one another.

12. A hand percussion instrument, comprising:

a. at least two substantially parallel and extended hollow tubes spaced apart from one another, one higher than the other;

b. loose rattle means in said tubes for making percussion sounds as they move about in said tubes; and c. handle means, extending across from one of said tubes to the other and connecting said tubes together, for gripping the instrument with the human hand between said spaced tubes and for moving the instrument about to cause said loose rattle means to produce percussion sound as they move about in said tubes, said handle means comprising.

at least one generally vertical handle member intersecting the upper, higher one of said tubes at substantially right angles, said handle member forming the gripping portion of said handle means and being in a plane different from said tubes, and at least one substantially horizontal arm attached at one end to the lower portion of said handle member and at the other end to the lower tube, said handle member and said arm forming at least generally an "L;" the intersections between said handle member and said upper tube and said arm and said lower tube being closed, the rattle means in said tubes being prevented from entering said handle member and said arm.

13. The instrument of claim 12 wherein said tubes are at least substantially linear.

14. The instrument of claim 13 wherein there is included two of said handle members and two of said arms, said intersections being at the ends of said tubes.

* * * * *